US006182297B1

(12) United States Patent
Duren et al.

(10) Patent No.: US 6,182,297 B1
(45) Date of Patent: Feb. 6, 2001

(54) LOWER TORSO SHAPE ENHANCING GARMENT

(76) Inventors: Michael T. Duren; James L. Franklin, both of 10562 High Hollows #146, Dallas, TX (US) 75230

( * ) Notice: Under 35 U.S.C. 154(b), the term of this patent shall be extended for 0 days.

(21) Appl. No.: 09/497,905

(22) Filed: Feb. 4, 2000

(51) Int. Cl.[7] ..... A41D 1/06
(52) U.S. Cl. ..... 2/228; 2/238; 2/69; 450/99
(58) Field of Search ..... 2/69, 67, 400–408, 2/227, 228, 238, 455, 456, 466, 79, 267, 268; 450/97–99, 101, 100, 102–104

(56) References Cited

U.S. PATENT DOCUMENTS

| | | | | |
|---|---|---|---|---|
| 680,379 | * | 8/1901 | Higley | 450/155 |
| 2,807,805 | * | 10/1957 | Allan | 2/228 |
| 2,824,565 | * | 2/1958 | Strickstein | 450/155 |
| 3,295,530 | * | 1/1967 | Mayer et al. | 450/99 |
| 4,894,867 | * | 1/1990 | Ceravolo et al. | 2/238 |
| 4,945,571 | * | 8/1990 | Calvert | 2/467 |
| 4,969,216 | * | 11/1990 | Guelli | 2/400 |
| 5,103,505 | * | 4/1992 | Llorens | 2/400 |
| 5,551,082 | * | 9/1996 | Stewart et al. | 2/465 |
| 5,649,328 | * | 7/1997 | Martin | 2/238 |
| 5,842,232 | * | 12/1998 | Parrish | 2/400 |

* cited by examiner

*Primary Examiner*—Gloria M. Hale

(57) ABSTRACT

A lower torso shape enhancing garment for changing the appearance of a portion of the wearers body. The lower torso shape enhancing garment includes a short pant comprising a front portion, a rear portion and a pair of leg portions extend downwardly from the front and rear portions. A crotch area is located between the leg portions. The short pant comprises an upper opening defined by a waistband. The short pant comprises a pair of lower leg openings. The short pant comprises an interior surface and an exterior surface. A pair of rear pockets are formed in the short pant. The pockets are formed at laterally spaced locations on the rear portion of the short pant to position each of the pockets over a buttock of the wearer. Each of the pockets comprises an upper entry slit, spaced side boundaries, and a lower boundary. The upper entry slit opens into the interior surface of the short pant just below the upper opening. Each of a pair of rear contour inserts are removably insertable in one of the pair of rear pockets.

20 Claims, 2 Drawing Sheets

LOWER TORSO SHAPE ENHANCING GARMENT

BACKGROUND OF THE INVENTION

1. Field of the Invention

The present invention relates to athletic shorts and more particularly pertains to a new lower torso shape enhancing garment for changing the appearance of a portion of the wearers body.

2. Description of the Prior Art

The use of athletic shorts is known in the prior art. More specifically, athletic shorts heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,103,505; U.S. Pat. No. 4,945,571; U.S. Pat. No. 4,805,243; U.S. Pat. No. 5,271,101; U.S. Pat. No. 5,551,082; and U.S. Pat. No. Des. 205,287.

While these devices fulfill their respective, particular objectives and requirements, the aforementioned patents do not disclose a new lower torso shape enhancing garment. The inventive device includes a short pant for covering a lower portion of a torso of a wearer and an upper portion of the legs of the wearer. The short pant comprises a front portion for covering a portion of the front of the torso of the wearer. A rear portion is for covering a portion of the rear of the torso of the wearer including the buttocks of the wearer. A pair of leg portions extend downwardly from the front and rear portions. A crotch area is located between the leg portions. The short pant comprises an upper opening defined by a waistband for positioning adjacent the waist of the wearer. The short pant comprises a pair of lower leg openings. The short pant comprises an interior surface and an exterior surface. A pair of rear pockets are formed in the short pant. The pockets are formed at laterally spaced locations on the rear portion of the short pant to position each of the pockets over a buttock of the wearer. Each of the pockets comprises an upper entry slit, spaced side boundaries, and a lower boundary. The upper entry slit opens into the interior surface of the short pant just below the upper opening. Each of a pair of rear contour inserts are removably insertable in one of the pair of rear pockets.

In these respects, the lower torso shape enhancing garment according to the present invention substantially departs from the conventional concepts and designs of the prior art, and in so doing provides an apparatus primarily developed for the purpose of changing the appearance of a portion of the wearers body.

SUMMARY OF THE INVENTION

In view of the foregoing disadvantages inherent in the known types of athletic shorts now present in the prior art, the present invention provides a new lower torso shape enhancing garment construction wherein the same can be utilized for changing the appearance of a portion of the wearers body.

The general purpose of the present invention, which will be described subsequently in greater detail, is to provide a new lower torso shape enhancing garment apparatus and method which has many of the advantages of the athletic shorts mentioned heretofore and many novel features that result in a new lower torso shape enhancing garment which is not anticipated, rendered obvious, suggested, or even implied by any of the prior art athletic shorts, either alone or in any combination thereof.

To attain this, the present invention generally comprises a short pant for covering a lower portion of a torso of a wearer and an upper portion of the legs of the wearer. The short pant comprises a front portion for covering a portion of the front of the torso of the wearer. A rear portion is for covering a portion of the rear of the torso of the wearer including the buttocks of the wearer. A pair of leg portions extend downwardly from the front and rear portions. A crotch area is located between the leg portions. The short pant comprises an upper opening defined by a waistband for positioning adjacent the waist of the wearer. The short pant comprises a pair of lower leg openings. The short pant comprises an interior surface and an exterior surface. A pair of rear pockets are formed in the short pant. The pockets are formed at laterally spaced locations on the rear portion of the short pant to position each of the pockets over a buttock of the wearer. Each of the pockets comprises an upper entry slit, spaced side boundaries, and a lower boundary. The upper entry slit opens into the interior surface of the short pant just below the upper opening. Each of a pair of rear contour inserts are removably insertable in one of the pair of rear pockets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining, at least one embodiment of the invention in detail, it is to be understood that the invention is not limited in its application to the details of construction and to the arrangements of the components set forth in the following description or illustrated in the drawings. The invention is capable of other embodiments and of being, practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lower torso shape enhancing garment apparatus and method which has many of the advantages of the athletic shorts mentioned heretofore and many novel features that result in a new lower torso shape enhancing garment which is not anticipated, rendered obvious, suggested, or even implied by any of the prior art athletic shorts, either alone or in any combination thereof.

It is another object of the present invention to provide a new lower torso shape enhancing garment which may be easily and efficiently manufactured and marketed.

It is a further object of the present invention to provide a new lower torso shape enhancing garment which is of a durable and reliable construction.

An even further object of the present invention is to provide a new lower torso shape enhancing garment which is susceptible of a low cost of manufacture with regard to both materials and labor, and which accordingly is then susceptible of low prices of sale to the consuming public, thereby making such lower torso shape enhancing garment economically available to the buying public.

Still yet another object of the present invention is to provide a new lower torso shape enhancing garment which provides in the apparatuses and methods of the prior art some of the advantages thereof, while simultaneously overcoming some of the disadvantages normally associated therewith.

Still another object of the present invention is to provide a new lower torso shape enhancing garment for changing the appearance of a portion of the wearers body.

Yet another object of the present invention is to provide a new lower torso shape enhancing garment which includes a short pant for covering a lower portion of a torso of a wearer and an upper portion of the legs of the wearer. The short pant comprises a front portion for covering a portion of the front of the torso of the wearer. A rear portion is for covering a portion of the rear of the torso of the wearer including the buttocks of the wearer. A pair of leg portions extend downwardly from the front and rear portions. A crotch area is located between the leg portions. The short pant comprises an upper opening defined by a waistband for positioning adjacent the waist of the wearer. The short pant comprises a pair of lower leg openings. The short pant comprises an interior surface and an exterior surface. A pair of rear pockets are formed in the short pant. The pockets are formed at laterally spaced locations on the rear portion of the short pant to position each of the pockets over a buttock of the wearer. Each of the pockets comprises an upper entry slit, spaced side boundaries, and a lower boundary. The upper entry slit opens into the interior surface of the short pant just below the upper opening. Each of a pair of rear contour inserts are removably insertable in one of the pair of rear pockets.

Still yet another object of the present invention is to provide a new lower torso shape enhancing garment that reshapes the buttocks of the wearer providing greater confidence in their appearance.

Even still another object of the present invention is to provide a new lower torso shape enhancing garment that reshapes the abdominal area of a wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
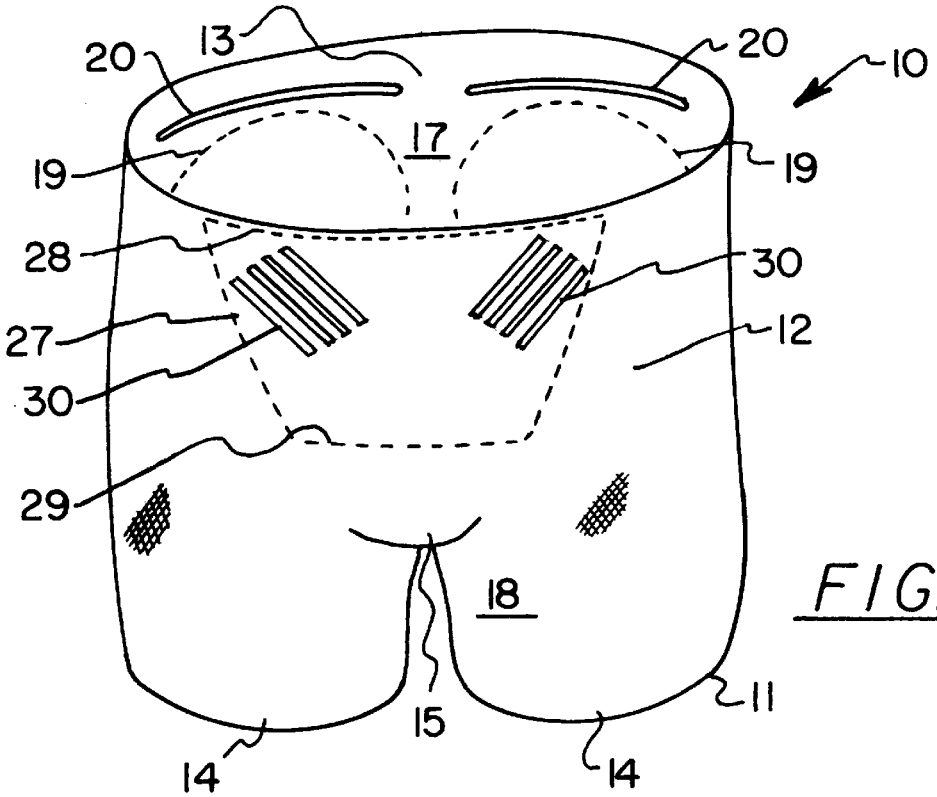
FIG. 1 is a front perspective view of a new lower torso shape enhancing garment according to the present invention.

With reference now to the drawings, and in particular to FIGS. 1 through 5 thereof, a new lower torso shape enhancing garment embodying the principles and concepts of the present invention and generally designated by the reference numeral 10 will be described.

As best illustrated in FIGS. 1 through 5, the lower torso shape enhancing garment 10 generally comprises a short pant 11 for covering a lower portion of a torso of a wearer and an upper portion of the legs of the wearer. The short pant comprises a front portion 12 for covering a portion of the front of the torso of the wearer. A rear portion 13 is for covering a portion of the rear of the torso of the wearer including the buttocks of the wearer. A pair of leg portions 14 extend downwardly from the front and rear portions. A crotch area 15 is located between the leg portions. The short pant comprises an upper opening defined by a waistband 16 for positioning adjacent the waist of the wearer. The short pant comprises a pair of lower leg openings. The short pant comprises an interior surface 17 and an exterior surface 18. The short pant is made of an elastomeric material.

Figure 2:
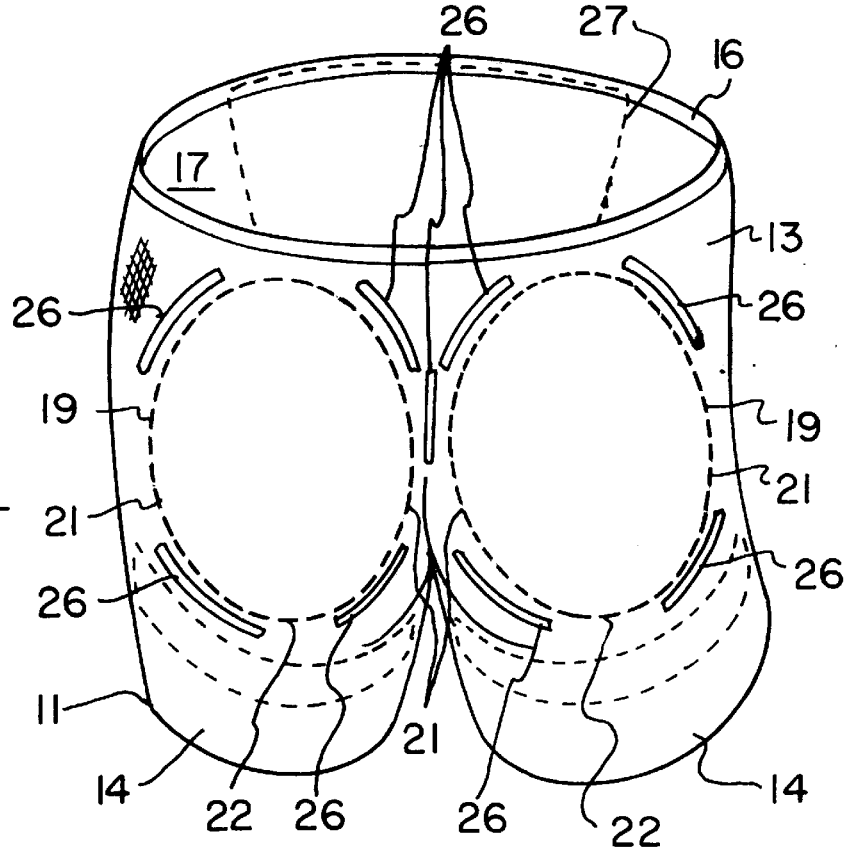
FIG. 2 is a rear perspective view of the present invention.
Figure 3:
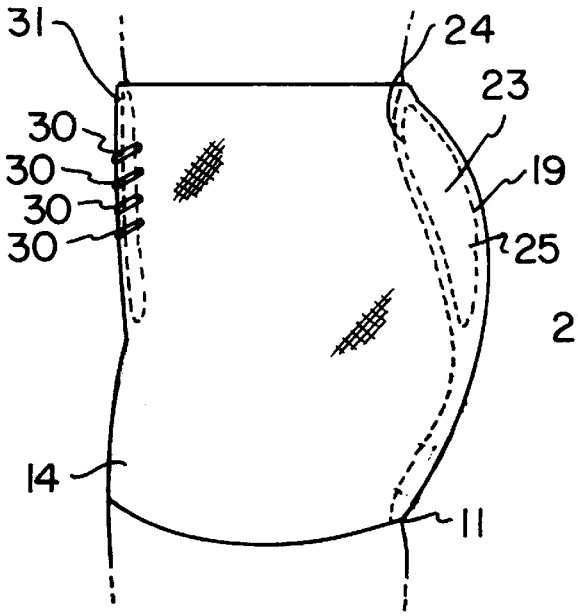
FIG. 3 is a side elevational view of the present invention.
Figure 4:
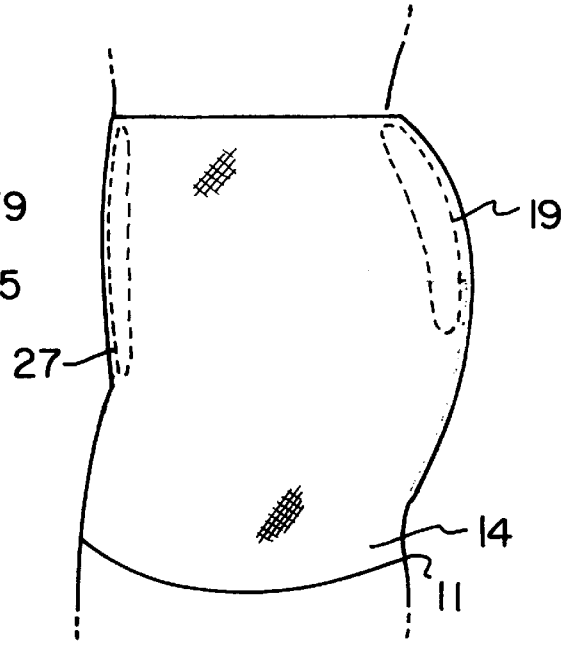
FIG. 4 is a side elevational view of the present invention with the inserts removed.

As shown in FIGS. 2 through 4, a pair of rear pockets 19 are formed in the short pant. The pockets are formed at laterally spaced locations on the rear portion of the short pant to position each of the pockets over a buttock of the wearer. Each of the pockets comprises an upper entry slit 20, spaced side boundaries 21, and a lower boundary 22. The upper entry slit opens into the interior surface of the short pant just below the upper opening. The lower boundary of the rear pockets are above a line extending parallel to a perimeter of the upper opening and is located approximately one half way between the upper opening and the lower leg openings to position the rear pocket upwards of the protrusion of the buttock of the wearer.

Figure 5:
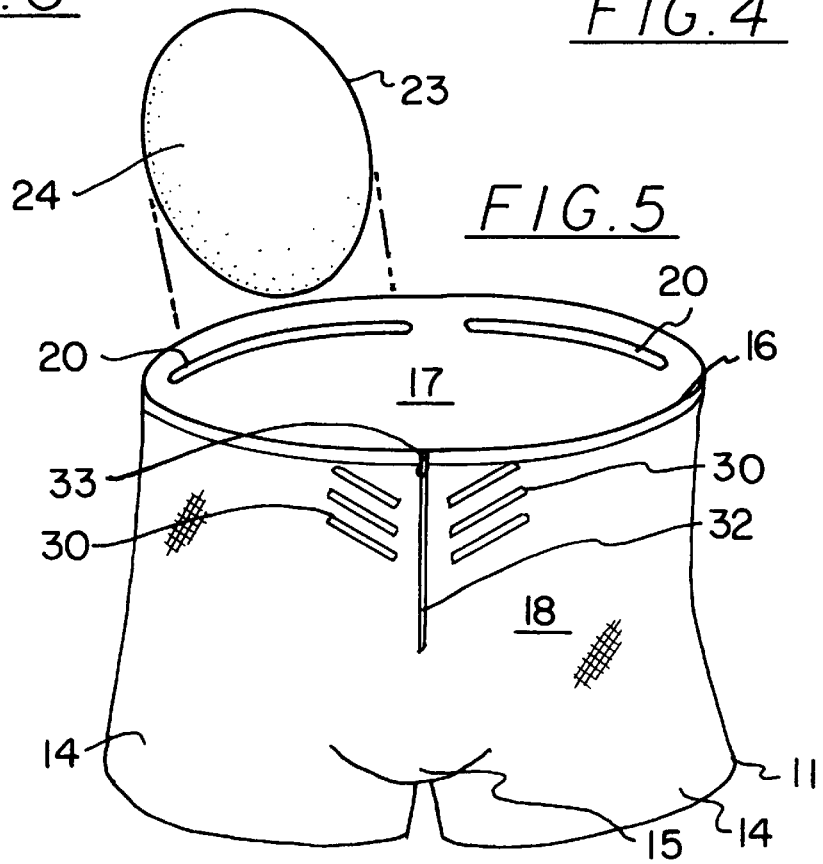
FIG. 5 is a front perspective view of the present invention with one of the inserts shown exploded away from the pocket.

As shown in FIG. 5, a pair of rear contour inserts 23 with each of the rear contour inserts removably insertable in one of the pair of rear pockets. Each of the rear contour inserts comprise an oblong perimeter shape. Each of the rear contour inserts comprises an inner surface 24 and an outer surface 25. The inner surface is generally concave and the outer surface is generally convex. The convexity of the outer surface comprises a relatively smaller radius of curvature than the radius of curvature of the concavity of the inner surface for enhancing the rounded profile of an upper portion of the buttock of the wearer. Each of the rear inserts is a soft flexible member. Each of the rear inserts comprises an outer integument filled with a silicon gel material.

As shown in FIGS. 2, a plurality of elongate strips 26 extend around each of the rear pockets for contouring the buttocks of the wearer adjacent to the rear pocket. Each of the elonoate strips is arcuate along a length of the strip. A pair of the elongate strips are positioned adjacent to a lower boundary of the rear pocket. A pair of the elongate strips are positioned adjacent to the upper entry slit of the rear pocket. One of the elongate strips is positioned between the rear pockets for positioning in the cleavage of the buttocks for forming a groove in the rear portion between the rear pockets. Each of the elongate strips is formed of a resiliently flexible material for resisting the bending of the strips.

As shown in FIGS. 1 and 5, a front pocket 27 is formed in the front portion of the short pant. The front pocket extends across the front portion of the short pants. The front pocket comprises a trapezoidal shape. An upper portion 28 of the front pocket is laterally wider than a lower portion 29 of the front pocket.

A plurality of elongate abdominal bars 30 are formed on the front portion of the short pant for simulating abdominal muscle contours. The plurality of abdominal bars comprises two sets of abdominal bars. Each set of abdominal bars is located at a laterally spaced location from the other set of abdominal bars. Each set of abdominal bars comprises a longitudinal extent oriented parallel to an axis extending between the crotch area and laterally outer location of the upper opening. Each set of abdominal bars comprises three bars.

A front insert panel 31 is removably insertable into the front pocket. The front insert panel is generally planar and substantially stiff for pressing against any protrusion of the abdomen of the wearer. The front insert panel comprises a trapezoidal shape that tapers downwardly on the torso of the wearer. An entry slit 32 extends from the upper opening toward the crotch area. The entry slit is releasably closable by a closure means, such that the closure means comprises a zipper device 33.

In use, the wearer would place the inserts into the rear pockets of the short pant for the appearance that is desired. The short pant would then be pulled on and worn under clothing so as to alter the appearance of the buttock area of the wearer. The front insert panel can be inserted in the front pocket of the short pant so as to reduce any abdominal protrusion that the wearer might have.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A garment for enhancing the apparent shape of the lower torso of the wearer, the lower torso of the wearer having an abdominal area and a pair of buttocks, the garment comprising:

a short pant for covering a lower portion of the torso of the wearer and an upper portion of the legs of the wearer, the short pant having a front portion for covering a portion of the front of the torso of the wearer, a rear portion for covering a portion of the rear of the torso of the wearer including the buttocks of the wearer, a pair of leg portions extending downwardly from the front and rear portions, a crotch area between the leg portions, the short pant having an upper opening defined by a waistband for positioning adjacent the waist of the wearer, the short pant having a pair of lower leg openings, the short pant having an interior surface and an exterior surface;

a pair of rear pockets formed in the short pant, the pockets being formed at laterally spaced locations on the rear portion of the short pant to position each of the pockets over a buttock of the wearer, each of the pockets having an upper entry slit, spaced side boundaries, and a lower boundary, wherein the upper entry slit opens into the interior surface of the short pant just below the upper opening;

a pair of rear contour inserts, each of the rear contour inserts being removably insertable in one of the pair of rear pockets; and a plurality of elongate strips extending around each of the rear pockets for contouring the buttocks of the wearer adjacent to the rear pocket, each of the elongate strips being arcuate along a length of the strip, a pair of the elongate strips being positioned adjacent to a lower boundary of the rear pocket.

2. The garment as set forth in claim 1, wherein the lower boundary of the rear pockets is above a line extending parallel to a perimeter of the upper opening and being located approximately one half way between the upper opening and the lower leg openings to position the rear pocket upwards of the protrusion of the buttock of the wearer.

3. The garment as set forth in claim 1, wherein each of the rear contour inserts has an oblong perimeter shape, each of the rear contour inserts having an inner surface and an outer surface, the inner surface being generally concave and the outer surface being generally convex.

4. The garment as set forth in claim 3, wherein the convexity of the outer surface has a relatively smaller radius of curvature than the radius of curvature of the concavity of the inner surface for enhancing the rounded profile of an upper portion of the buttock of the wearer.

5. The garment as set forth in claim 1, wherein each of the rear inserts is a soft flexible member, each of the rear inserts comprising an outer integument filled with a silicon gel material.

6. The garment as set forth in claim 1, wherein, a pair of the elongate strips is positioned adjacent to the upper entry slit of the rear pocket, one of the elongate strips being positioned between the rear pockets for positioning in the cleavage of the buttocks for forming a groove in the rear portion between the rear pockets.

7. The garment as set forth in claim 1 wherein, each of the elongate strips is formed of a resiliently flexible material for resisting the bending of the strips.

8. The garment as set forth in claim 1 further comprises a front pocket formed in the front portion of the short pant, the front pocket extending across the front portion of the short pants.

9. The garment as set forth in claim 7 wherein, the front pocket has a trapezoidal shape, an upper portion of the front pocket being laterally wider than a lower portion of the front pocket.

10. The garment as set forth in claim 7 further comprises a front insert panel being removably insertable into the front pocket, the front insert panel being generally planar and substantially stiff for pressing against any protrusion of the abdomen of the wearer.

11. The garment as set forth in claim 9 wherein, the front insert panel has a trapezoidal shape that tapers downwardly on the torso of the wearer.

12. The garment as set forth in claim 1 further comprises a plurality of elongate abdominal bars formed on the front portion of the short pant for simulating abdominal muscle contours, the plurality of abdominal bars comprising two sets of abdominal bars, each set of abdominal bars being located at a laterally spaced location from the other set of abdominal bars.

13. The garment as set forth in claim 12 wherein, each set of abdominal bars has a longitudinal extent oriented parallel to an axis extending between the crotch area and laterally outer location of the upper opening, each set of abdominal bars comprising three bars.

14. The garment as set forth in claim 1 further comprises an entry slit extending from the upper opening toward the crotch area, the entry slit being releasably closable by a closure means, wherein the closure means comprises a zipper device.

15. A garment for enhancing the apparent shape of the lower torso of the wearer, the lower torso of the wearer having an abdominal area and a pair of buttocks, the garment comprising:

a short pant for covering a lower portion of the torso of the wearer and an upper portion of the legs of the wearer, the short pant having a front portion for covering a portion of the front of the torso of the wearer, a rear portion for covering a portion of the rear of the torso of the wearer including the buttocks of the wearer, a pair of leg portions extending downwardly from the front and rear portions, a crotch area between the leg portions, the short pant having an upper opening defined by a waistband for positioning adjacent the waist of the wearer, the short pant having a pair of lower leg openings, the short pant having an interior surface and an exterior surface;

a pair of rear pockets formed in the short pant, the pockets being formed at laterally spaced locations on the rear portion of the short pant to position each of the pockets over a buttock of the wearer, each of the pockets having an upper entry slit, spaced side boundaries, and a lower boundary, wherein the upper entry slit opens into the interior surface of the short pant just below the upper opening;

a pair of rear contour inserts, each of the rear contour inserts being removably insertable in one of the pair of rear pockets; and a plurality of elongate abdominal bars formed on the front portion of the short pant for simulating abdominal muscle contours, the plurality of abdominal bars comprising two sets of abdominal bars, each set of abdominal bars being located at a laterally spaced location from the other set of abdominal bars.

16. A garment for enhancing the apparent shape of the lower torso of the wearer, the lower torso of the wearer having an abdominal area and a pair of buttocks, the garment comprising:

a short pant for covering a lower portion of the torso of the wearer and an upper portion of the legs of the wearer, the short pant having a front portion for covering a portion of the front of the torso of the wearer, a rear portion for covering a portion of the rear of the torso of the wearer including the buttocks of the wearer, a pair of leg portions extending downwardly from the front and rear portions, a crotch area between the leg portions, the short pant having an upper opening defined by a waistband for positioning adjacent the waist of the wearer, the short pant having a pair of lower leg openings, the short pant having an interior surface and an exterior surface;

a pair of rear pockets formed in the short pant, the pockets being formed at laterally spaced locations on the rear portion of the short pant to position each of the pockets over a buttock of the wearer, each of the pockets having an upper entry slit, spaced side boundaries, and a lower boundary, wherein the upper entry slit opens into the interior surface of the short pant just below the upper opening;

a pair of rear contour inserts, each of the rear contour inserts being removably insertable in one of the pair of rear pockets; and a front pocket formed in the front portion of the short pant, the front pocket extending across the front portion of the short pants.

17. The garment as set forth in claim 15, wherein each set of abdominal bars has a longitudinal extent oriented parallel to an axis extending between the crotch area and laterally outer location of the upper opening, each set of abdominal bars comprising three bars.

18. The garment as set forth in claim 16, wherein the front pocket has a trapezoidal shape, an upper portion of the front pocket being laterally wider than a lower portion of the front pocket.

19. The garment as set forth in claim 16, further comprises a front insert panel being removably insertable into the front pocket, the front insert panel being generally planar and substantially stiff for pressing against any protrusion of the abdomen of the wearer.

20. The garment as set forth in claim 19, wherein the front insert panel has a trapezoidal shape that tapers downwardly on the torso of the wearer.

* * * * *